US008967251B2

(12) United States Patent
Koroteev et al.

(10) Patent No.: US 8,967,251 B2
(45) Date of Patent: Mar. 3, 2015

(54) METHOD OF A FORMATION HYDRAULIC FRACTURING

(75) Inventors: Dmitry Anatolievich Koroteev, Moscow (RU); Andrei Alexandrovich Osiptsov, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 562 days.

(21) Appl. No.: 13/330,896

(22) Filed: Dec. 20, 2011

(65) Prior Publication Data

US 2012/0152549 A1 Jun. 21, 2012

(30) Foreign Application Priority Data

Dec. 21, 2010 (RU) ..... 2010152074

(51) Int. Cl.
*E21B 43/26* (2006.01)

(52) U.S. Cl.
CPC ..... *E21B 43/26* (2013.01)
USPC ..... 166/250.1; 166/308.1

(58) Field of Classification Search
CPC ..... E21B 43/26
USPC ..... 166/250.01, 250.1, 308.1
See application file for complete search history.

(56) References Cited

U.S. PATENT DOCUMENTS

| | | | | |
|---|---|---|---|---|
| 4,786,020 | A | 11/1988 | Franke et al. | |
| 4,932,610 | A | 6/1990 | Maestrello | |
| 4,932,612 | A | 6/1990 | Blackwelder et al. | |
| 5,372,482 | A * | 12/1994 | London et al. | 417/12 |
| 6,776,235 | B1 | 8/2004 | England | |
| 7,302,849 | B2 | 12/2007 | Segal et al. | |
| 7,451,812 | B2 | 11/2008 | Cooper et al. | |
| 2011/0265998 | A1 | 11/2011 | Boronin et al. | |

FOREIGN PATENT DOCUMENTS

| | | |
|---|---|---|
| EA | 11447 | 2/2009 |
| RU | 2276258 | 10/2005 |
| RU | 2327154 | 6/2008 |
| RU | 2347218 | 2/2009 |
| RU | 2008140628 | 4/2010 |
| RU | 2402679 | 10/2010 |

OTHER PUBLICATIONS

Anonymous, "Laminar to Turbulent Flow Transition Control using Lyapunov's Direct Method," A. James Clark School of Engineering Morpheus Laboratory Department of Aerospace Engineering, 2010: pp. 1-2, <http://www.morpheus.umd.edu/research/active-flow-control/flow-control.html>.

Anonymous (Webworm), "Estimate Pump Power Consumption without Vendor Information," Chemical & Process Technology, Jul. 2008: pp. 1-3, <http://webwormcpt.blogspot.com/2008/07/estimate-pump-power-consumption-without.html>.

(Continued)

*Primary Examiner* — Nicole Coy

(57) ABSTRACT

Method of a formation hydraulic fracturing provides injection of a hydraulic fracturing fluid into a borehole with the increase of a fluid flow rate to a working value. During the injection a power consumption of a pump used for the injection is measured continuously. A pump power consumption jump indicates the fracturing fluid flow turbulization in the borehole.

8 Claims, 1 Drawing Sheet

(56) References Cited

OTHER PUBLICATIONS

Gimatudinov, "2. Materials used for Hydraulic Fracturing, 3. Operating Procedure, 4. Identifying Crack Formation Locations," Oil Production Reference Book, Nedra Publishing: Moscow, 1974: pp. 456-459.

Schlichting, "Experimental Results for Smooth Pipes," Boundary Layer Theory, Nauka Publishing: Moscow, ed.: Loitsyansky, 1974: p. 537.

Wilson et al., "2. Review of Fluid and Particle Mechanics," Slurry Transport Using Centrifugal Pumps, Third Edition, New York: Springer Science+Business Media, Inc., 2006: pp. 27-30 and 34.

* cited by examiner

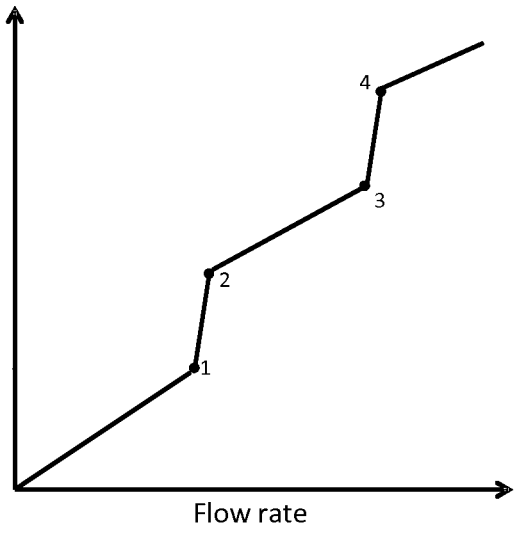
4
3
2
1
Flow rate

METHOD OF A FORMATION HYDRAULIC FRACTURING

CROSS-REFERENCE TO RELATED APPLICATION

This applications claims priority to Russian Patent Application Serial No. 2010152074 filed Dec. 21, 2010, which is incorporated by reference herein in its entirety.

TECHNICAL FIELD

The invention is related to the area of hydraulic fracturing in underground formations and may be applied, particularly, in oil and gas fields.

BACKGROUND

Hydraulic fracturing is the main process to improve the productive formation bottomhole zone permeability by making fractures and/or widening and deepening of the natural cracks therein. For this purpose a high pressure fracturing agent is pumped into the borehole crossing the underground formation. The formation deposits or rock is forced to cracking and fracturing. The proppant is pumped into the crack to prevent the fracture closing after the formation pressure is released, it provides improved fluid (i.e., oil, gas or water) production.

To conduct hydraulic fracturing activities hydraulic fracturing fluids with different rheology are used depending on the activity purposes and formation properties. In case of high-permeable formations high-viscosity fracturing fluids are injected into a fracture and characteristic velocity of such flows are low. Such flows are usually laminar, i.e., different flow strata are not mixed. However, during the hydraulic fracturing activities in low-permeable formations (for example, at shale gas fields) low-viscosity fracturing fluids with large injection rates are used. Such flows may lose stability which results in the fact that the flow becomes turbulent when all the flow characteristics get chaotic in all the scale lengths. In case of a turbulent flow the suspension in the fracture is constantly mixed. It usually results in significant changes in the particle distribution because the chaotic pulsations result in the uniform distribution of the proppant particles across the fracture. Large-scale vortexes prevent the particles from settling and maintain them suspended thus reducing the particles' settling rate.

In U.S. Pat. No. 6,776,235 a method of a formation hydraulic fracturing is proposed in which a proppant settling rate is adjusted by controlling the injection rate. However, this method does not provide monitoring of the flow mode of the fracturing fluid being injected and does not allow ensuring uniform proppant filling of the entire fracture assisting the formation of relatively dense proppant packages in the sporadically located fracture areas.

The method being suggested provides for a real time monitoring of a hydraulic fracturing fluid flow in a fracture and in a borehole with subsequent injection parameter adjustment depending on the specific purposes of the formation hydraulic fracturing activities aimed at increased hydrocarbons inflow.

SUMMARY

A formation hydraulic fracturing method comprises a hydraulic fracturing fluid injection into a borehole by a pump, increasing of a flow rate of the hydraulic fracturing fluid during its injection up to a working value, simultaneously measuring a power consumption of the pump and determining a turbulization of the hydraulic fracturing fluid flow in the borehole by a first jump of the pump power consumption.

The flow rate increase and simultaneous measurement of the pump power consumption may be continued. In this case, a second jump of the power consumption is the indicator of the fracturing fluid flow turbulization in a fracture. If necessary the injection rate may be changed.

The pump motor may be electric in which case the power consumption is measured by means of an electrical power meter.

An internal combustion engine may also be used as the pump motor, and the power consumption is measured by real time metering of a fuel consumption.

BRIEF DESCRIPTION OF THE DRAWING

The invention is explained by a drawing (FIG. 1) which shows the power consumption as function of the hydraulic fracturing fluid flow rate.

DETAILED DESCRIPTION

It is known that the fluid effective viscosity sharply grows after a laminar-turbulent transition. The flow of a hydraulic fracturing fluid in a borehole may be treated as tube flow and the flow of the hydraulic fracturing fluid in a fracture may be treated as a flat channel flow. Whereas the rate average value exceeds the critical value for this geometry and fluid properties (the flow Reynolds number exceeds the critical value), the flow mode changes from laminar to turbulent. The turbulent flow mode is characterized by chaotic fluctuations of the flow parameters.

Depending on the specific field conditions either laminar or turbulent mode may be desirable. Due to the fact that after laminar-to-turbulent transition the flow friction losses increase significantly, a power consumption of the pump used to inject the hydraulic fracturing fluid into the borehole (with the flow rate being equal) significantly increases in the turbulent mode as compared to laminar mode. Consequently, by measuring the pump power consumption with the smooth flow rate change, the moment when the power consumption grown sharply may be determined. This power consumption jump is a clear symptom of the borehole/fracture laminar-to-turbulent transition; and the operator, depending on the specific activity objectives, may either continue working at the same flow rate, or reduce the flow rate to prevent transition to turbulent mode.

To present specific evaluations of the power consumption increase during the laminar-to-turbulent transition, let us consider the flow mode in the production string tube. Suppose the tube length is l=3000 m and radius r=0.0325 m. According to [H. Schlichting, J. Kestin, Boundary-layer Theory, (McGraw-Hill, 1979)], pressure drop Δp at the tube length is connected with the section-averaged flow rate u by the following equation:

$$\frac{\Delta p}{l} = \lambda \frac{\rho u^2}{4R}, \tag{1}$$

where ρ is the fluid density, λ—tube hydraulic drag coefficient. For the laminar and turbulent flow modes, λ is expressed as follows:

$$\lambda_{lam} = \frac{64}{Re}, \quad (2)$$

$$\lambda_{turb} = \frac{0.32}{\sqrt[4]{Re}}, \quad (3)$$

$$Re = \frac{2\rho u R}{\mu}, \quad (4)$$

where μ is the fluid viscosity, Re—Reynolds number.

Let us consider two flow modes with equal (critical) Reynolds number values. From Equations (1)-(3) it follows that in the transitional area with an equal flow rate (and equal Reynolds numbers) the pressure drop values for different modes correlate as follows:

$$\frac{\Delta p_{turb}}{\Delta p_{lam}} = \frac{\lambda_{turb}}{\lambda_{lam}} = 0.005 \cdot Re^{0.75}. \quad (5)$$

Assuming that the laminar-to-turbulent transition occurs at Re=2500, we obtain that:

$$\frac{\Delta p_{turb}}{\Delta p_{lam}} \approx 1.8. \quad (6)$$

Therefore, the pressure drop in turbulent mode is nearly by factor 2 higher than in laminar mode. In the first approximation the power consumed by the pump is proportional to the pressure drop generated. This enables expecting a significant increase of the power consumed in the laminar-to-turbulent transition in the production string tube. As it is known from hydraulic mechanics theory speed vs. pressure drop correlations for the flat channel flow are similar. Therefore, in the laminar-to-turbulent transition in the fracture the same values of the pressure drop variations should be expected.

If the pump has an electric motor, the power consumption may be controlled using an electrical power meter. If the pump is driven by an internal combustion engine, the power consumed may be characterized by the variations in online fuel consumption measurements.

Normally, the laminar-to-turbulent transition occurs in the production string tube at lower flow rates than those in the fracture. Therefore, the proposed formation hydraulic fracturing method is implemented as follows.

A fracturing fluid is injected into a borehole using a pump. The fracturing fluid flow rate is gradually increased until it reaches a working value with the simultaneous measurement of a power consumed by the pump. During the registration of a first power consumption jump (see FIG. 1, Section 1-2) the flow in the production string tube becomes turbulent, whereas the flow in a fracture remains laminar.

Depending on the problem in question an operator either continues working in this mode or reduces the flow rate to prevent the transition to the turbulent flow. As a rule, borehole flow turbulization is better to be avoided because it increases the hydrodynamic drag and, consequently, increases the pump power consumption. However, sometimes proppant's positioning across and along the borehole may be required and in this case transition to the borehole turbulent mode may be needed.

If necessary the flow rate is increased further (FIG. 1, Section 2-3). The second jump of the power consumption indicates the flow turbulization in the fracture (FIG. 1, Section 3-4). Again, the operator makes a decision of the flow rate reduction to prevent the transition to turbulent mode, or to continue working in the turbulent mode. For example, flow turbulization in the fracture be required to provide maximum uniform distribution of the proppant particles. On the other hand to minimize the power consumption the fracture laminar flow maintaining may be required.

With the flow rates exceeding the flow rate in point 4 the flow is turbulent, both in the production string tube and in the fracture.

The invention claimed is:

1. Method of a formation hydraulic fracturing comprising:

injecting a hydraulic fracturing fluid into a borehole by a pump, increasing a flow rate of the hydraulic fracturing fluid during its injection, simultaneously measuring a power consumption of the pump, determining a transition to a turbulent flow of the hydraulic fracturing fluid in the borehole by a first jump of the pump power consumption and controlling the flow of the hydraulic fracturing fluid by adjusting the flow rate of the fluid.

2. The method of claim 1 wherein after the first pump power consumption jump the flow rate of the hydraulic fracturing fluid is decreased to prevent turbulization of the hydraulic fracturing fluid flow in the borehole.

3. The method of claim 1 wherein after the first pump power consumption jump the flow rate of the hydraulic fracturing fluid is increased with simultaneous measurement of the pump power consumption, and by a second jump of the pump power consumption a transition to a turbulent flow of the hydraulic fracturing fluid in a fracture is determined.

4. The method of claim 3 wherein after the second pump power consumption jump the flow rate of the hydraulic fracturing fluid is decreased to prevent turbulization of the hydraulic fracturing fluid flow in the fracture.

5. The method of claim 3 wherein after the second pump power consumption jump the flow rate of the hydraulic fracturing fluid is maintained equal to the flow rate of the hydraulic fracturing fluid at the moment of the second jump of the pump power consumption.

6. The method of claim 1 wherein an electric motor is used as a motor of the pump and the power consumption is measured by an electrical power meter.

7. The method of claim 1 wherein an internal combustion engine is used as a motor of the pump and the power consumption is measured by a real time measurement of a fuel consumption.

8. The method of claim 1 wherein after the first pump power consumption jump the flow rate of the hydraulic fracturing fluid is maintained equal to the flow rate of the hydraulic fracturing fluid at the moment of the first jump of the pump power consumption.

* * * * *